United States Patent [19]

Francis et al.

[11] Patent Number: 4,981,150

[45] Date of Patent: Jan. 1, 1991

[54] FOUNDATION DRAIN CLEANING APPARATUS AND METHOD

[75] Inventors: Thomas Francis, Fraser; K. Rand Dykman, Armada, both of Mich.

[73] Assignee: Franman, Inc., Fraser, Mich.

[21] Appl. No.: 335,878

[22] Filed: Apr. 10, 1989

Related U.S. Application Data

[62] Division of Ser. No. 182,178, Apr. 15, 1988, Pat. No. 4,848,380.

[51] Int. Cl.[5] ..... B08B 3/02; B08B 9/04; B08B 9/06

[52] U.S. Cl. ..... 134/22.120; 134/167 C; 239/578

[58] Field of Search ..... 134/167 C, 168 C; 134/8, 24, 26, 25.1, 25.4, 22.12, 22.18; 210/767; 52/742; 405/43; 15/104.33; 239/578

[56] References Cited

U.S. PATENT DOCUMENTS

| | | | |
|---|---|---|---|
| 3,007,186 | 11/1961 | Olsson | 15/104.33 |
| 3,370,599 | 2/1968 | Ciaccio | 134/167 C |
| 3,658,589 | 4/1972 | Shaddock | 134/168 C X |
| 4,073,302 | 2/1978 | Jones | 134/167 C |
| 4,349,039 | 9/1982 | Egger | 239/578 X |
| 4,764,180 | 8/1988 | Shaddock | 134/167 C X |
| 4,773,113 | 9/1988 | Russell | 134/168 C X |
| 4,838,768 | 6/1989 | Flaherty | 134/167 C X |

FOREIGN PATENT DOCUMENTS

| | | | |
|---|---|---|---|
| 564489 | 10/1958 | Canada | 134/167 C |

OTHER PUBLICATIONS

*Chemical Engineering*, Oct. 23, 1967, p. 89, Ad of Halliburton Co.

*Primary Examiner*—Philip R. Coe
*Attorney, Agent, or Firm*—Gerald R. Black

[57] ABSTRACT

This is a new apparatus and method for cleaning debris from the inside of a foundation drain tile, the drain tile being in the immediate proximity of the perimeter of a building structure. A rocket nozzle which is in fluid communication with flexible tubing and a high pressure water supply, and a foot pedal control valve is used for starting and stopping the fluid flow. An opening in the tip of the nozzle enables pressurized water to be discharged through the tip in a forward direction. At least two apertures are disposed along a nozzle recess. The tubing is secured to the nozzle and is in fluid communication with the nozzle. An on-off foot pedal control valve is used to start and stop the water flow into the tubing and into the nozzle. As pressurized water is supplied to the nozzle and projected through the apertures, the nozzle is propelled in a forward direction through the drain tile. The flow of the pressurized water through the nozzle causes the pressurized water to be projected through the opening in the nozzle tip. As the nozzle is propelled through the drain tile, the water flowing through the nozzle tip is continually directed at the debris at sufficient force to separate the debris from the drain. To assist in cleaning the drain tile, a series of cleanout pipes are installed near the junctures of the drain tile and conventional pipes located underneath the basement floor.

21 Claims, 2 Drawing Sheets

FOUNDATION DRAIN CLEANING APPARATUS AND METHOD

This is a division of the application Ser. No. 182,178, filed Apr. 15, 1988, and now U.S. Pat. No. 4,848,380.

BACKGROUND OF THE INVENTION

1. Field of the Invention

The present invention relates to a new apparatus and method for cleaning foundation drain tiles located in the immediate proximity of the perimeter of a building structure.

2. Background Art

Conventional single and multi-family dwellings and other building structures are typically built upon foundation walls which define the basement area. The foundation walls and the footers are in direct contact with the ground surrounding the home. Most such building structures have a drainage system in the immediate proximity of the foundation which enables water and debris immediately surrounding the building structure and the side walls to drain away therefrom. The drain tile is generally located around the perimeter of the basement slightly below the foundation. The drain tile is water porous, allowing water to enter therein and routed through the drain tile to a sewer or a sump pump. The drain tile is generally located within a bed of water-permeable material such as gravel, the gravel bed surrounding the basement foundation.

When the drain tile becomes blocked at various locations with silt and other debris, as frequently occurs, the drain tile is extremely difficult to clean. The drain tile may be interconnected to the eaves wherein leaves and twigs, roof tar, and even the remains of small animals may become lodged in the drain tile. Since the flow of water and debris through the drain tile is at most a trickle, the drain tile never is flushed out. The property owner is confronted with choosing between digging several feet deep into the land surrounding the building structure to access and clean-out the existing drain tile, or inserting a new drain tile under the basement floor and thereby gutting major portions of the existing basement floor.

What is needed is a new method and apparatus for cleaning the existing drain tile that will overcome these disadvantages and will not require a major upheaval of the grounds surrounding the building structure, or destroying the the basement floor.

SUMMARY OF THE INVENTION

The primary advantage of the apparatus and method of the present invention is that it enables debris to be effectively cleaned from the existing drain tile, while minimizing the damage done to the land around the building structure, the basement floor, and the drain tile.

Another advantage of the present invention is that the drain tile may be thoroughly and efficiently cleaned by one operator working alone, and thereafter routinely cleaned and maintained on a regular basis.

The cleaning apparatus of the present invention consists of a rocket nozzle in fluid communication with flexible tubing, a high pressure fluid supply, and a foot pedal for starting and stopping the fluid flow. The rocket nozzle has a head portion and a tail portion. The head portion has an opening on the tip thereof through which a pressurized fluid, preferably water, is dischargeable in a forward direction. The tail portion of the nozzle is in fluid communication with a high pressure water supply. The nozzle has a recess between the head portion and the tail portion, the recess having a rearward surface. At least two apertures are disposed along the recess. The flexible tubing and all fittings used therein are capable of withstanding the flow of high pressure water. The tubing is secured to the nozzle and is in fluid communication with the nozzle. As pressurized water is supplied to the nozzle, the water is projected through the apertures. This water projecting in the rearward direction propels the nozzle with a forward thrust in a forward direction and thereby enables the rocket nozzle to move through the drain tile.

To clean the foundation drain tile, it is first necessary to locate the junctures of the interconnecting pipes that are located underneath the basement floor with the various segments of the drain tile. The position of each juncture is determined by inserting the rocket nozzle of the cleaning apparatus into a centralized drain in the basement floor. The nozzle is in fluid communication with a high pressure fluid supply line. The nozzle is propelled through the interconnecting pipe, but will stop at the juncture between the pipe and the drain tile since the nozzle cannot overcome the radical bend between the interconnecting pipe and the drain tile. The position of the nozzle is located by the sound that the fluid makes which can be heard through the floor of the basement as the water is projected through the nozzle. Once the position of a juncture is located, a cleanout pipe is inserted into the basement floor by digging up the basement floor around the juncture. The cleanout pipe is installed so that it is in fluid communication with the interconnecting pipe, preferably just inside the foundation wall, and the cleanout pipe is accessible from the basement floor.

After the cleanout pipes have been installed, highly pressurized water is supplied to the cleaning apparatus at a sufficient pressure to project the nozzle through the drain tile enabling the nozzle to cut through essentially any blockage that may exist. A foot pedal control valve is used to start and stop the water flow into the tubing and into the nozzle. The valve is operable by the operator applying pressure to the pedal.

The flow of the pressurized water through the nozzle causes the pressurized water to be projected through the opening in the nozzle tip. As the nozzle is propelled through the drain tile, the water flowing through the nozzle tip is continually directed at blockages of the debris with sufficient force to bore through the blockages and separate the debris from the drain tile.

For a more complete understanding of the foundation drain cleaning apparatus and methods of the present invention, reference is made to the following detailed description and accompanying drawings in which the presently preferred embodiment of the invention is illustrated by way of example. It is expressly understood, however, that the drawings are for purposes of illustration and description only, and are not intended as a definition of the limits of the invention. Throughout the following description and drawings, identical reference numbers refer to the same component throughout the several views.

DETAILED DESCRIPTION OF THE INVENTION

Figure 2:
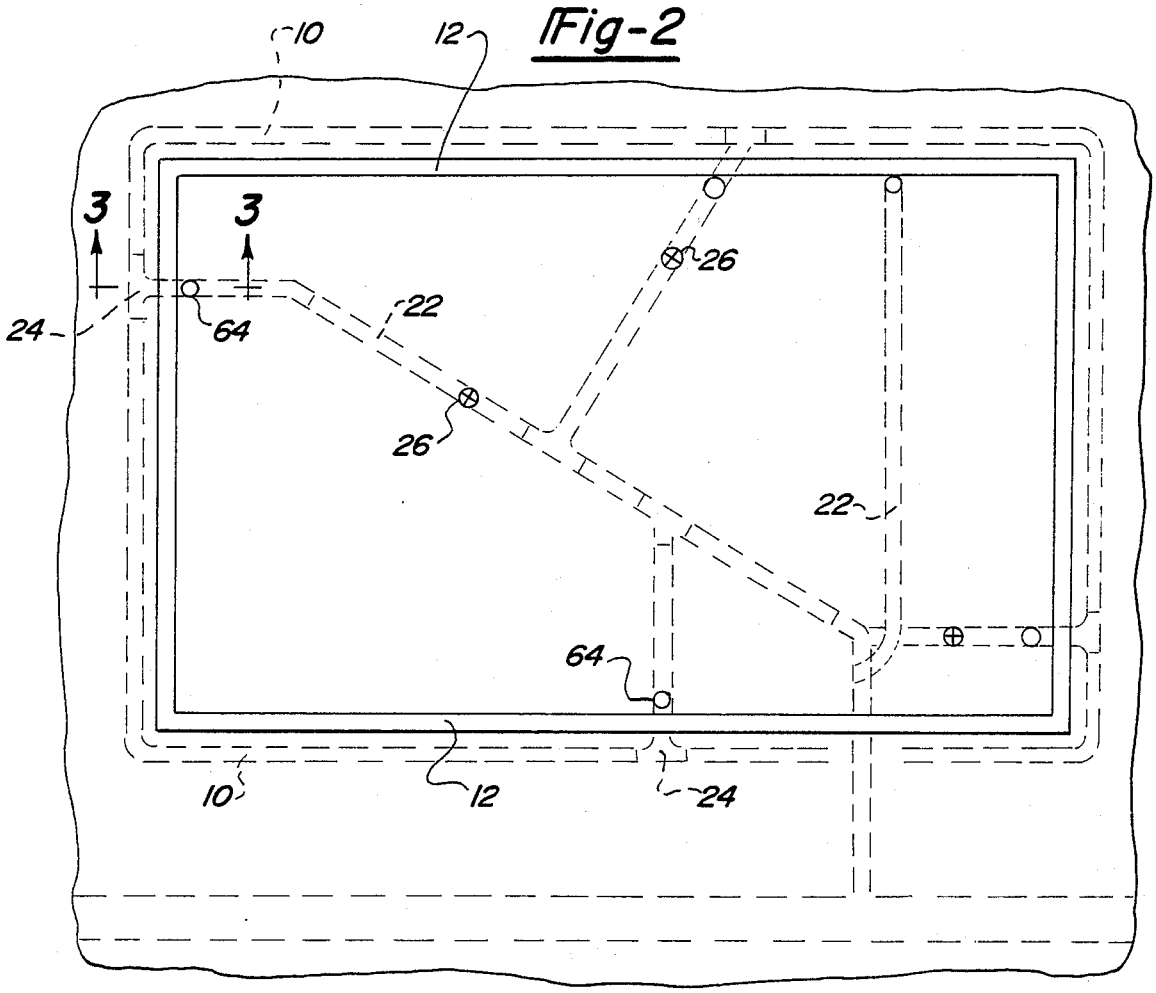
FIG. 2 is a plan view of a typical foundation drain located around the perimeter of a building structure.

Referring now to the drawings, a conventional drain tile 10 is shown in FIG. 2 which surrounds the perimeter of the building structure 12. It is to be understood, however, that the principles of this invention are equally applicable to any foundation drain tile system, including a drain tile that is located underneath the perimeter of the basement 14, and that the system depicted in FIG. 2 is used only for purposes of illustration.

The basement floor 12 is usually poured concrete. The side walls 16 are of conventional construction and are built up from a plurality of individual concrete blocks 18 which are positioned on a footer 15. Gravel 20 is filled over the drain tile 10 and thereabouts. The gravel 20 is water permeable material which permits the water to readily filter and pass through the porous wall of the tile 10.

The drain tile 10 is situated relative to the building structure 12 so that any water that collects in the vicinity of the building structure 12 is routed across and into the drain tile 10. The drain tile 10 consists of water porous tile and is laid in a continuous channel that feeds into either a sump pump or a centralized sewer. Building drain tiles are generally in fluid communication with a series of interconnecting pipes 22, which are required by building codes to prevent blockage therein, at a series of junctures 24, the pipes 22 being disposed underneath the basement floor 14 of the building structure 12. Generally, these interconnecting pipes 22 have more gradual bends in the direction of fluid flow and are accessible through one of several floor drains 26 located in the basement floor 14. These interconnecting pipes 22 can be extremely important and useful in cleaning the drain tile 10, as will be later described.

Figure 1:
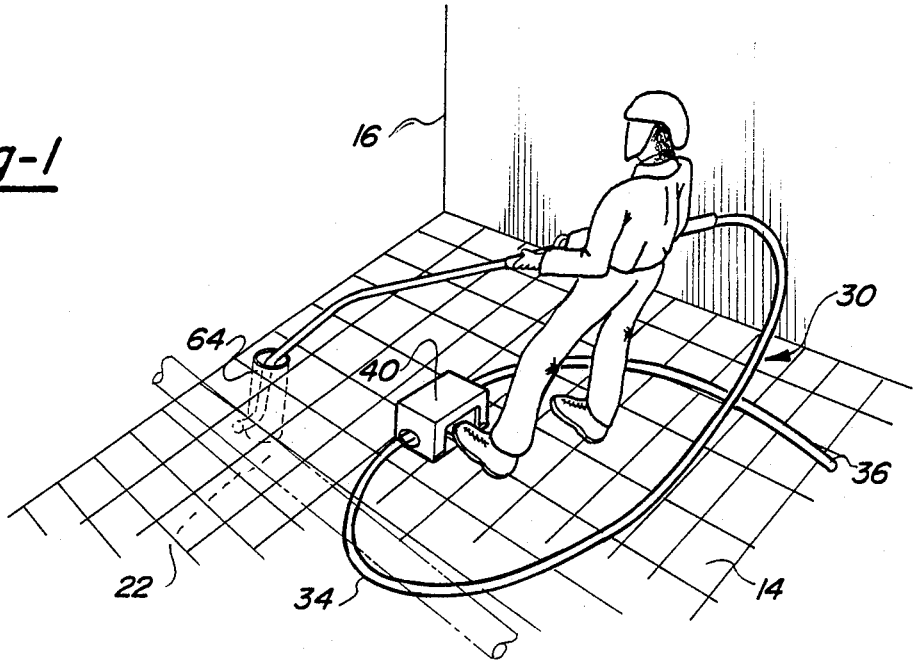
FIG. 1 is a perspective view of the preferred embodiment of the foundation drain cleaning apparatus of the present invention.

FIG. 1 shows a perspective view of the foundation drain tile cleaning apparatus 30 of the present invention. The apparatus 30 consists of a rocket nozzle 32 in fluid communication with flexible tubing 34, a high pressure fluid supply 36, and a foot pedal control valve 40 for starting and stopping the fluid flow.

Figure 4:
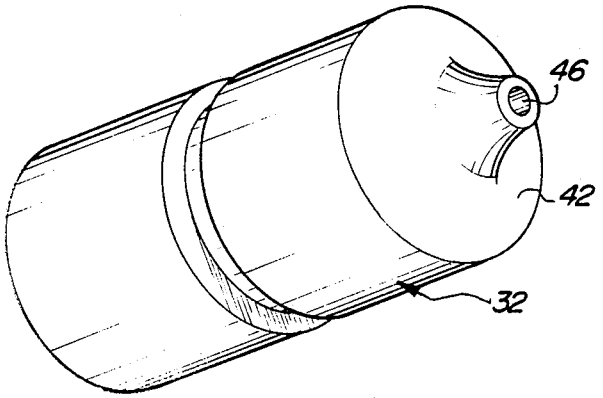
FIG. 4 is a detailed perspective view of the nozzle depicted in FIG. 1.
Figure 4A:
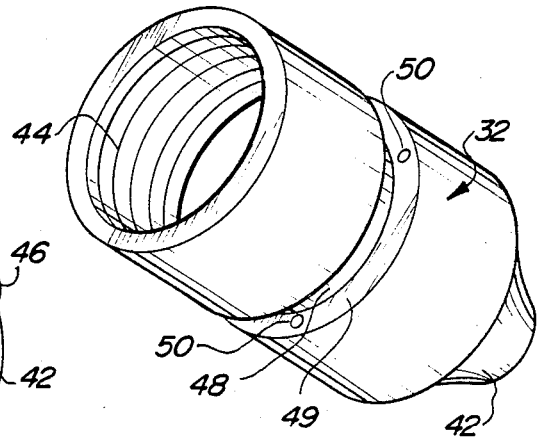
FIG. 4A is another detailed perspective view of the nozzle depicted in FIG. 4.

The rocket nozzle of the present invention 32 (as depicted in FIGS. 4 and 4A) is made of tool steel, and has a head portion 42 and a tail portion 44. The high pressure waterblast nozzles 32 are commercially available from the NLB Corporation, and are designated as Part No. P-4 10K. The head portion 42 has an opening 46 on the tip thereof through which pressureized fluid, preferably water, is dischargeable in the forward direction. The tail portion 44 of the nozzle 32 is in fluid communication with a high pressure water supply. The nozzle 32 has a recess 48 between the head portion and the tail portion, the recess having a rearward surface 49. At least two apertures 50 are disposed along the recess 48. The water propelled through the apertures 50 serves the dual function of (1) propelling the cleaning apparatus 30 through the drain tile 10, and (2) cleaning the inside surface of the drain tile 10.

The greater the number of apertures 50, the greater will be the propelling force applied to move the nozzle 32 farther into the drain tile 10, but the lesser will be the force of the water jet projected from the tip 46 of the nozzle 32. Similarly, as the number of apertures 50 decreases, the propelling force diminishes, but the greater will be the force of the water jet projected from the tip 46 of the nozzle 32. The operator will usually have to use more than one nozzle 32 to locate the junctures 24 and to clean the complete drain tile 10, depending upon the remoteness of the locations of the blockages in the line. Generally, the cleaning out of the debris from the inside of the drain tile 10 is completed by using a nozzle 32 with no tip opening 46, so that the pressure of the water jets projecting from the apertures 50 is maximum.

The flexible tubing 34 is capable of withstanding the flow of high pressure water. The tubing 34 is secured to the nozzle 32 by tubing fittings that are capable of withstanding high pressure water flow. The tubing 34 is in fluid communication with the nozzle 32. Water at a pressure between 2200 and 5200 psi is supplied to the tubing 34. A pump (not shown) of standard design that is well known in the art is connected to the tap water to raise the supply pressure of the water to the desired range. A high pressure supply line is used to connect the water pump to the foot pedal control valve 40. The flow rate of water through the nozzle 32 is about 4.5 gallons/minute.

Figure 5:
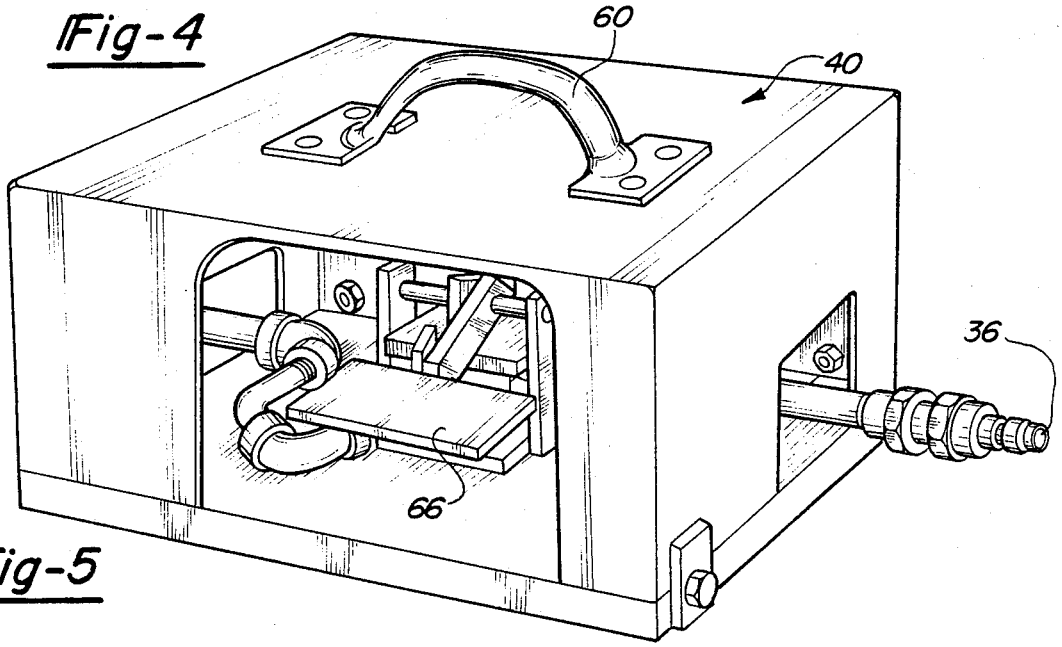
FIG. 5 is a detailed perspective view of the foot pedal control valve shown in FIG. 2.

FIG. 5 depicts the on-off foot pedal control valve 40, which is used to start and stop the water flow into the tubing and into the nozzle. The operation of the foot control valve 40 is similar to the operation of a gun, except that it is operated by a foot pedal instead of a hand lever. The unit is preferably lightweight and portable, having a handle 60 for the easy transporting thereof.

The control valve 40 receives pressurized water through a supply line 62. The supply line 62 is in fluid communication with an output line 64, the output line 64 being insertable into the drain tile 10 to be cleaned. The control valve 40 has a lever 66 which is actuated by a foot of the operator, the lever 66 being preferably spring-actuated. When fluid is flowing through the control valve 40 actuation of the lever 66 by the operator will terminate fluid flow to the output line 64. When fluid is not flowing through the control valve 40 but is being provided through the supply line 62 actuation of the lever 66 by the operator will initiate fluid flow to the output line 64. By operating the control valve 40 with his foot the operator has both hands free to manipulate the flexible tubing 34 into and through the drain tile 10. Also, for prolonged usage of the cleaning apparatus 30 it is considerably easier for an operator to apply pressure with a foot than by hand. The operator must always be in control of the flexible tubing 34 and the nozzle 32, particularly when the nozzle 32 is close to the entry into the drain tile 10, because of the risk of personal injury from the high pressure water.

As pressurized water is supplied to the nozzle 32, the water is projected through the apertures 50, propelling the nozzle 32 in a forward direction through the drain tile 10. The flow of the pressurized water through the nozzle 32 causes the pressureized water to be projected through the tip opening 46 in the nozzle 32. As the nozzle 32 is propelled through the drain tile 10, the water flowing through the nozzle tip 46 is continually directed at the debris at sufficient force to separate the debris from the drain tile 10. The water serves the dual function of washing the debris through the drain tile 10 and into either a sump pump or a central sewer.

The method of the present invention can be used to clean the foundation drain tile 10 by first locating the position of the junctures 24 of the interconnecting pipes 22 with the drain tile 10. The interconnecting pipes 22 are in fluid communication with the various segments of the drain tile 10 at a series of junctures 24.

First, the position of each juncture 24 is determined by inserting the rocket nozzle 32 of the cleaning apparatus 30 depicted in FIG. 1 into a centralized drain 64 in the basement floor 14. The rocket nozzle 32 is in fluid communication with a high pressure fluid supply line 36. The rocket nozzle 32 is propelled through the interconnecting pipe 22 when the control apparatus 30 is energized. The nozzle 32 will stop at the juncture 24 between the interconnecting pipe 22 and the drain tile 10, since the rocket nozzle 32 cannot ordinarily overcome the radical bends that generally exists between the interconnecting pipe 22 and the drain tile 10. Also, the pressure in the supply line 36 can be maintained at a low enough level to regulate the movement of the rocket nozzle 32 around these corners. The operator can overcome the radical bends in the pipes 22 and the drain tile 10 with a rapid series of bursts on the lever 66 of the foot pedal control valve 40 coupled with his turning the flexible tubing 34. The position of the rocket nozzle 32 is located through the floor of the basement 14 by the sound that the fluid makes as it escapes from the nozzle 32.

Figure 3:
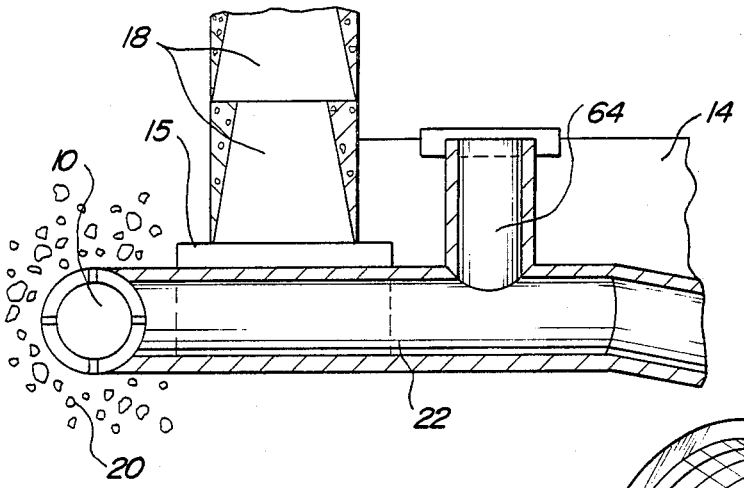
FIG. 3 is a sectional side view depicting a juncture of the drain tile and interconnecting pipe taken along Section 3—3 of FIG. 2.

Once the position of a juncture 24 is located, a cleanout pipe 64 is inserted into the basement floor 14 by digging through the basement floor 14 in the vicinity of the juncture 24. The cleanout pipe 64 is installed so that it is in fluid communication with the interconnecting pipe 22. The cleanout pipe 64 is preferably located just inside the foundation sidewalls 16, and the cleanout pipe 64 is located so that it is accessible from the basement floor 14 for subsequent cleaning and maintenance of the drain tile 10. As shown in FIG. 3 the cleanout pipes 64 are preferably joined to the interconnecting pipes 22 underneath the basement floor 14 near each juncture 24 along each wall of the building structure.

The rocket nozzle 32 is inserted into the drain tile 10. Once the cleanout pipe 64 is inserted into the interconnecting pipe 22 near a juncture 24, the nozzle 32 is inserted at least sixteen inches into the cleanout line 64. The operator then pushes down on the foot pedal control valve 40, which enables all of the water to be directed into the rocket nozzle 32. The sixteen inch point on the flexible tube 34 is marked with tape, so that it can be easily recognized when the rocket nozzle 32 is withdrawn front the drain tile, so that the foot pedal control valve 40 can be shut down and the cleaning apparatus 30 de-energized. As pressurized fluid is projected through the nozzle apertures 50 in a rearward direction, the rocket nozzle 32 is propelled through the drain tile 10 in a forward direction. As pressurized fluid is projected through the nozzle tip opening 46 in a forward direction, the jet spray separates the debris from the drain tile 10.

While the foundation drain cleaning apparatus and method have been described in conjunction with a specific embodiment, it is evident that many alternatives, modifications, and variations will be apparent to those skilled in the art in light of the disclosure herein. It is intended that all such alternatives, modifications, and variations are included herein that fall within the spirit and scope of the appended claims.

We claim:

1. An apparatus for enabling an operator to clean debris with pressurized fluid from a drain tile system and a piping system, the piping system being in fluid communication with the drain tile system, the drain tile system and piping system being disposed in the immediate proximity of a building structure, the apparatus comprising:

(a) a rocket nozzle having a plurality of openings disposed therein through which the pressurized fluid is dischargeable therefrom in a rearward direction thereby propelling the rocket nozzle in a forward direction;

(b) flexible tubing capable of withstanding the flow of the pressurized fluid, the flexible tubing being securable to the reocket nozzle, the flexible tubing being attachable with a fluid supply means which supplies the pressurized fluid to the flexible tubing at pressures in the range of 2200 to 5200 psi; and (c) means for enabling the operator to interrupt the flow of the pressurized fluid into the rocket nozzle while the operator is holding the fluid line in his hands.

2. The apparatus of claim 1, wherein the pressurized fluid is water that not only separates the debris from the drain tile and the piping system but also washes the debris through the piping system.

3. The apparatus of claim 1, wherein the enabling means is a fluid control valve, the fluid control valve being positionable between the fluid supply means and the rocket nozzle, the control valve being engageable in fluid communication with the flexible tubing.

4. The apparatus of claim 3, wherein the fluid control valve comprises a foot pedal, the flow of the pressurized fluid through the fluid line being stopable with the application of force to the foot pedal by the operator.

5. An apparatus for enabling an operator to clean debris with pressurized fluid from a drain tile system and a piping system, the piping system being in fluid communication with the drain tile system, the drain tile system and piping system being disposed in the immediate proximity of a building structure, the apparatus comprising:

(a) a rocket nozzle having a plurality of openings disposed therein from which the pressurized fluid is dischargeable in a rearward direction thereby propelling the rocket nozzle in a forward direction;

(b) flexible tubing capable of withstanding the flow of the pressurizing fluid, the flexible tubing being securable to the rocket nozzle;

(c) a fluid supply means for supplying the pressurized fluid through the flexible tubing, the flexible tubing being attachable in fluid communication with the fluid supply means; and (d) a fluid control valve that is disposed between the fluid supply means and the rocket nozzle, the fluid control valve being directly engageable by the operator to start and stop the flow of pressurized fluid through the flexible tubing, wherein the fluid control valve comprises a foot pedal which enables the operator to interrupt the flow of the pressurized fluid while holding the fluid line in his hands.

6. The apparatus of claim 5, wherein the pressurized fluid is water that not only separates the debris from the drain tile and the piping system but also washes the debris through the piping system.

7. The apparatus of claim 5, wherein the fluid supply means supplies pressurized water to the flexible tubing and the rocket nozzle at pressures ranging from 2200 to 5200 psi.

8. The apparatus of claim 5, wherein the rocket nozzle has an aperture disposed on the tip thereof to clear blockages disposed in the drain tile and the piping system.

9. An apparatus for enabling an operator to clean debris with pressurized fluid from a drain tile system and a piping system, the piping system being in fluid communication therewith, the drain tile system and piping system being disposed in the immediate proximity of a building structure, the apparatus comprising:

(a) a rocket nozzle having a plurality of openings disposed therein through which the pressurized water is dischargeable therefrom in a rearward direction thereby propelling the rocket nozzle in a forward direction, the rocket nozzle having an aperture disposed on the tip thereof to discharge the pressurized fluid in a forward direction to clear blockages disposed in the drain tile and the piping system;

(b) flexible tubing capable of withstanding the flow of the pressurized fluid, the flexible tubing being securable to the rocket nozzle;

(c) a fluid supply means for supplying the pressurized fluid to the flexible tubing at pressures ranging from 2200 to 5200 psi, the flexible tubing being attachable with the fluid supply means; and (d) a fluid control valve that is disposed between the fluid supply means and the rocket nozzle, the control valve having a foot pedal which enables the operator to interrupt the flow of the presurized fluid through the flexible tubing while holding the fluid line in his hands.

10. A method of removing debris from a drain tile system and a piping system for a building structure, the piping system being in fluid communication with the drain tile system, the drain tile system being disposed proximate to the perimeter of the building structure, the method comprising of the steps of:

(a) providing a clean-out pipe, the clean-out pipe being accessible from inside the building structure, the clean-out pipe being in fluid communication with the piping system;

(b) inserting a rocket nozzle into the clean-out pipe from inside the building structure, the rocket nozzle being in fluid communication with a supply of pressurized fluid, the rocket nozzle having a plurality of apertures disposed in a rearward orientation;

(c) propelling the rocket nozzle through the clean-out pipe and into the piping system in a forward direction, the pressurized fluid escaping through the rearwardly oriented apertures of the rocket nozzle as the highly pressurized fluid separates the debris from the piping system; and (d) interrupting the flow of the pressurized fluid into the rocket nozzle by the use of a fluid control valve, the fluid control valve being operable by an operator without the use of the hands of the operator.

11. The method of claim 10, wherein the fluid control valve comprises a foot pedal, the flow of the pressurized fluid through the fluid line being interrupted by the application of force to the foot pedal.

12. The method of claim 10, further comprising:

initiating the flow of the pressurized fluid into the rocket nozzle by use of a fluid control valve after the rocket nozzle has been inserted into the clean-out pipe, the fluid control valve having a foot pedal, the flow of the pressurized fluid through the fluid line being deactivated by the application of force to the foot pedal.

13. A method for an operator to remove debris from a drain tile system and a piping system for a building structure, the piping system being in fluid communication with the drain tile system, the drain tile system being disposed proximate to the perimeter of the building structure, the method comprising:

(a) inserting a rocket nozzle into the piping system, the rocket nozzle being in fluid communication with the fluid line and a supply of pressurized fluid, the fluid line being made of a flexible material, the fluid line having a passage disposed therethrough, the rocket nozzle having a plurality of apertures disposed therein through which the pressurized fluid is dischargeable therefrom in a rearward direction thereby propelling the rocket nozzle in a forward direction;

(b) initiating the flow of the pressurized fluid into the rocket nozzle by use of a fluid control valve, the fluid control valve having a foot pedal, the flow of the pressurized fluid through the fluid line being initiated by the application of force to the foot pedal; and (c) propelling the rocket nozzle through the piping system in a forward direction, the pressurized fluid escaping through the rearwardly oriented apertures of the rocket nozzle as the highly pressurized fluid separates the debris from the piping system.

14. The method of claim 13, wherein the operator is able to initiate the flow of the pressurized fluid through the fluid line while holding and controlling the fluid line in his hands.

15. The method of claim 13, wherein the foot control valve is mechanically engaged with the fluid line so that the application of pressure to the foot pedal causes the passage in the fluid line to close.

16. A method for an operator to remove debris from a drain tile system and a piping system for a building structure, the piping system being in fluid communication with the drain tile system, the drain tile system being disposed proximate to the perimeter of the building structure, the method comprising:

(a) inserting a rocket nozzle into the piping system, the rocket nozzle being in fluid communication with the fluid line and a supply of pressurized fluid, the fluid line being made of a flexible material, the fluid line having a passage disposed therethrough, the rocket nozzle having a plurality of apertures disposed therein through which the pressurized fluid is dischargeable therefrom in a rearward direction;

(b) propelling the rocket nozzle through the piping system in a forward direction, the pressurized fluid escaping through the rearwardly oriented apertures of the rocket nozzle as the highly pressureized fluid separates the debris from the piping system; and (c) interrupting the flow of the pressurized fluid into the rocket nozzle by use of a fluid control valve, the fluid control valve having a foot pedal, the flow of the pressurized fluid through the fluid line being interrupted by the application of force to the foot pedal.

17. The method of claim 16, wherein the operator is able to interrupt flow of the pressurized fluid through the fluid line while holding and controlling the fluid line in his hands.

18. The method of claim 16, wherein the foot control valve is mechanically engaged with the fluid line so that the application of pressure to the foot pedal causes the passage in the fluid line to close.

19. A method for an operator to remove debris from a drain tile system and a piping system for a building structure, the piping system being in fluid communication with the drain tile system, the drain tile system being disposed proximate to the perimeter of the building structure, the method comprising:

(a) inserting a rocket nozzle into the piping system, the rocket nozzle being in fluid communication with the fluid line and a supply of pressurized fluid, the fluid line being made of a flexible material, the fluid line having a passage disposed therethrough, the rocket nozzle having a plurality of apertures disposed therein through which the pressurized fluid is dischargeable therefrom in a rearward direction;

(b) initiating the flow of the pressurized fluid into the rocket nozzle by the operator while the operator is holding the fluid line in his hands;

(c) propelling the rocket nozzle through the piping system in a forward direction as the operator holds the fluid line in his hands, the pressurized fluid escaping through the apertures of the rocket nozzle as the highly pressurized fluid separates the debris from the piping system; and (d) interrupting the flow of the pressurized fluid into the rocket nozzle by the operator while the operator is holding the fluid line in his hands.

20. The method of claim 19, wherein the flow of the pressurized fluid into the rocket nozzle is initiated by use of a fluid control valve, the fluid control valve having a foot pedal, the flow of the pressurized fluid through the fluid line being initiated by the application of force to the foot pedal.

21. The method of claim 19, wherein the flow of the pressurized fluid into the rocket nozzle is interrupted by use of a fluid control valve, the fluid control valve having a foot pedal, the flow of the pressurized fluid through the fluid line being interrupted by the application of force to the foot pedal.

* * * * *